United States Patent [19]

Hathaway

[11] 4,097,783

[45] Jun. 27, 1978

[54] ULTRAVIOLET LIGHT PROCESSOR

[75] Inventor: Michael L. Hathaway, Aurora, Ill.

[73] Assignee: PPG Industries, Inc., Pittsburgh, Pa.

[21] Appl. No.: 722,470

[22] Filed: Sep. 13, 1976

[51] Int. Cl.[2] ..... H05B 41/36

[52] U.S. Cl. ..... 315/323; 315/120; 315/130; 315/240; 315/324; 315/360

[58] Field of Search ..... 315/120, 121, 130, 131, 315/254, 258, 312, 313, 323, 324, 228, 239, 240, 244, 360; 250/494, 495, 492 R

[56] References Cited

U.S. PATENT DOCUMENTS

| | | | |
|---|---|---|---|
| 2,859,387 | 11/1958 | Ulffers | 315/323 X |
| 2,861,218 | 11/1958 | Powell, Jr. | 315/323 X |
| 3,499,781 | 3/1970 | Krueckel | 117/38 |
| 3,875,067 | 4/1975 | De Sorgo et al. | 250/527 |
| 3,911,320 | 10/1975 | Crawford et al. | 315/240 |
| 3,943,046 | 3/1976 | De Sorga et al. | 204/159.23 |
| 3,984,726 | 10/1976 | Ramler | 315/107 |

FOREIGN PATENT DOCUMENTS

| | | | |
|---|---|---|---|
| 175,133 | 1965 | U.S.S.R. | 315/121 |

*Primary Examiner*—Eugene R. La Roche
*Attorney, Agent, or Firm*—George D. Morris

[57] ABSTRACT

The sources of ultraviolet light processors containing a plurality of such sources are started sequentially to reduce the current surge at start-up.

15 Claims, 6 Drawing Figures

| STEP \ ROW | 1 | 2 | 3 | 4 | 5 | 6 | 7 | 8 | 9 | 10 |
|---|---|---|---|---|---|---|---|---|---|---|
| 1 | X | | | | | | | | | |
| 2 | | X | | | | | | | | |
| 3 | | | X | | | | | | | |
| 4 | | | | X | | | | | | |
| 5 | | | | | X | | | | | |
| 6 | | | | | | X | | | | |
| 7 | | | | | | | | | | |
| 8 | | | | | | | | | | |
| 9 | | | | | | | | | | |
| 10 | | | | | | | X | X | X | X |

ULTRAVIOLET LIGHT PROCESSOR

Processes in which products are treated with ultraviolet light, such as to effect polymerization, sterilization, etc., are becoming of increasing interest. The use of ultraviolet light coating processors to cure ultraviolet light sensitive coatings is especially becoming more widespread. Advantages of ultraviolet light curing include the ability to use resin systems which have little or no volatile solvents, the speed with which cure may be accomplished and simplicity of operation.

Ultraviolet light processors often employ a plurality of sources of ultraviolet light. Usually, reflectors are employed to reflect ultraviolet light which would otherwise be lost to locations where it, together with ultraviolet light emanating directly from the sources, can be used to advantage. Often, conventional conveying means, such as a conveyor belt or link chain bearing a rotating mandrel is used for conveying workpieces through the useful field of ultraviolet radiation.

One problem that has caused difficulty in the use of ultraviolet light processors is that the connection of an ultraviolet light emitting lamp to a source of electrical power causes a surge of electrical current which is greater than the average current flowing during steady state operation. Although the surge of an individual lamp or small group of lamps is tolerable, many lamps connected in parallel produce a surge, the magnitude of which exceeds that which is tolerable or desirable. Such large surges can damage equipment or produce safety hazards.

The present invention serves to alleviate the above problem by including in an ultraviolet light processor a sequence of members for emitting ultraviolet light when connected to a source of electrical power, means for automatically and sequentially connecting members of the sequence to a source of electrical power to thereby cause the members to emit ultraviolet light, and timing means cooperating with the connecting means for interposing a time interval between connections of adjacent members of the sequence to the source of electrical power. The timing interval is such that the instantaneous current flowing during start-up is at or below a predetermined acceptable value.

For a better understanding of the invention, reference may be made to the drawing wherein like reference numerals refer to like parts in which.

Figure 5:
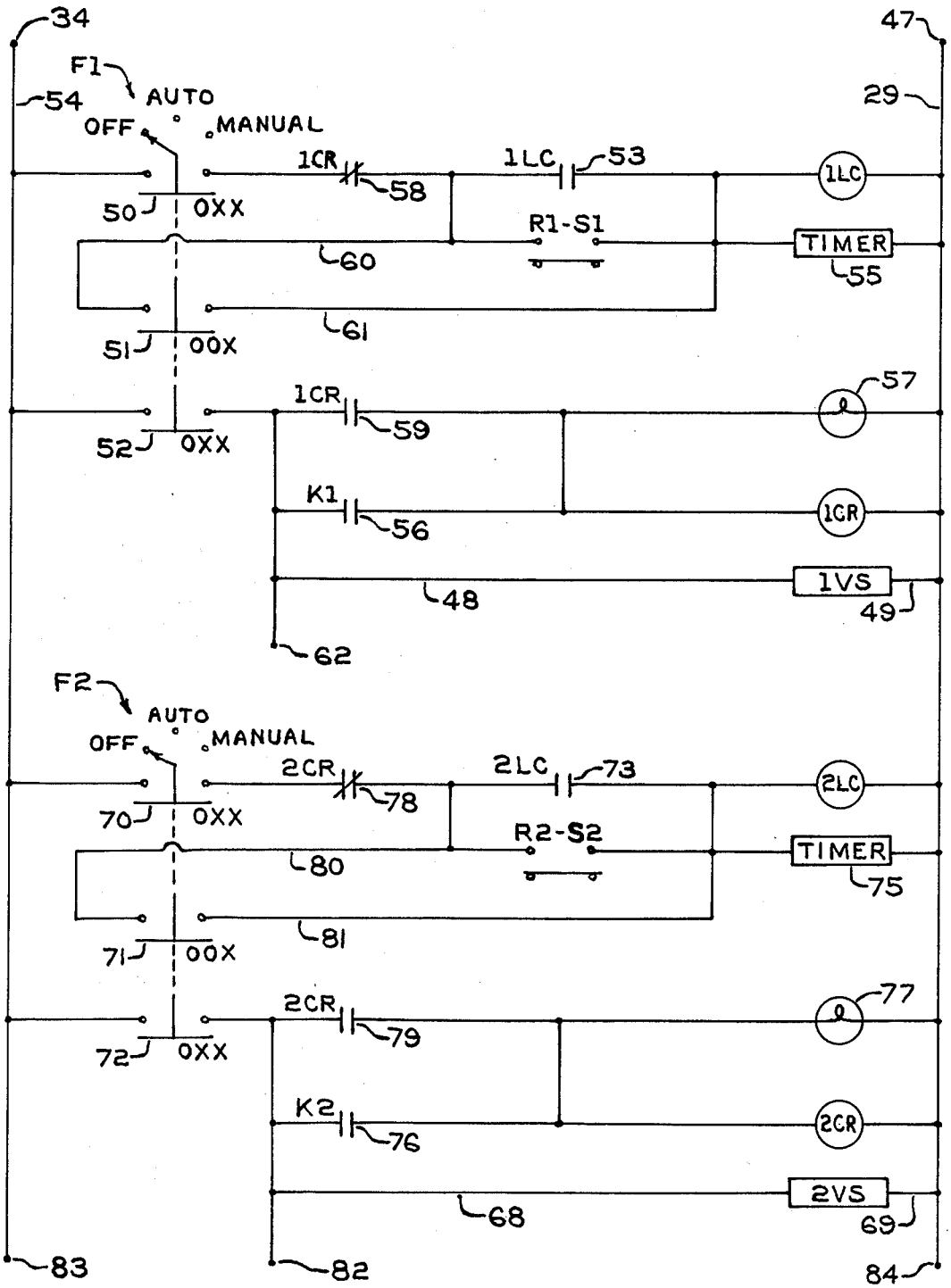
FIG. 5 shows a system for operating the electrical systems of FIGS. 1 and 2.

Referring now in detail to the figures where the invention will be described with respect to illustrative embodiments thereof, normally open contacts of switches are represented by two spaced, parallel lines such as for contacts 43 of FIG. 3. Normally closed contacts of switches are represented by two spaced, parallel lines transversed by a diagonal such as for contacts 33 in FIG. 3. Switches with the same nomenclature are moved simultaneously. For example, when switch Z of FIG. 3 is activated, contacts 33 are opened, contacts 41 are closed, contacts 42 are closed and contacts 43 are closed, all substantially simultaneously. Solenoids are represented by circles identified by nomenclature corresponding to the switches activated. Activation of solenoid Z, which is the same as solenoid 9, activates switch Z and, consequently, all contacts identified as Z. Gang switches are represented in the manner of function switch F1 of FIG. 5, comprising contacts 50, 51 and 52, respectively, which are shown positioned in the drawing for the most counterclockwise position of the switch. Adjacent each set of contacts is a diagram showing positions of the contacts for each position of the control knob as the control knob is turned stepwise in the clockwise direction. Closed contacts are represented by X, and open contacts are represented by O. The symbol for contacts 50 is OXX which means that when the control knob of function switch F1 is in the OFF position, contacts 50 are open; when the control knob is in the AUTO position, contacts 50 are closed; when the control knob is in the MANUAL position, contacts 50 are closed. Switches identified as R1-S1, R2-S2 (FIG. 5), R7-S10, R8-S10, R9-S10 and R10-S10 (FIG. 3) are activated by step programmer 30 (FIG. 3) as will be discussed in detail hereafter. Voltage sensors are represented by rectangles containing identifying nomenclature, as for example, voltage sensor 1VS (FIG. 5). Capacitors are represented by a spaced line and arc, as for example, capacitor C3 (FIG. 2), which is the same as capacitor 8.

Figure 1:
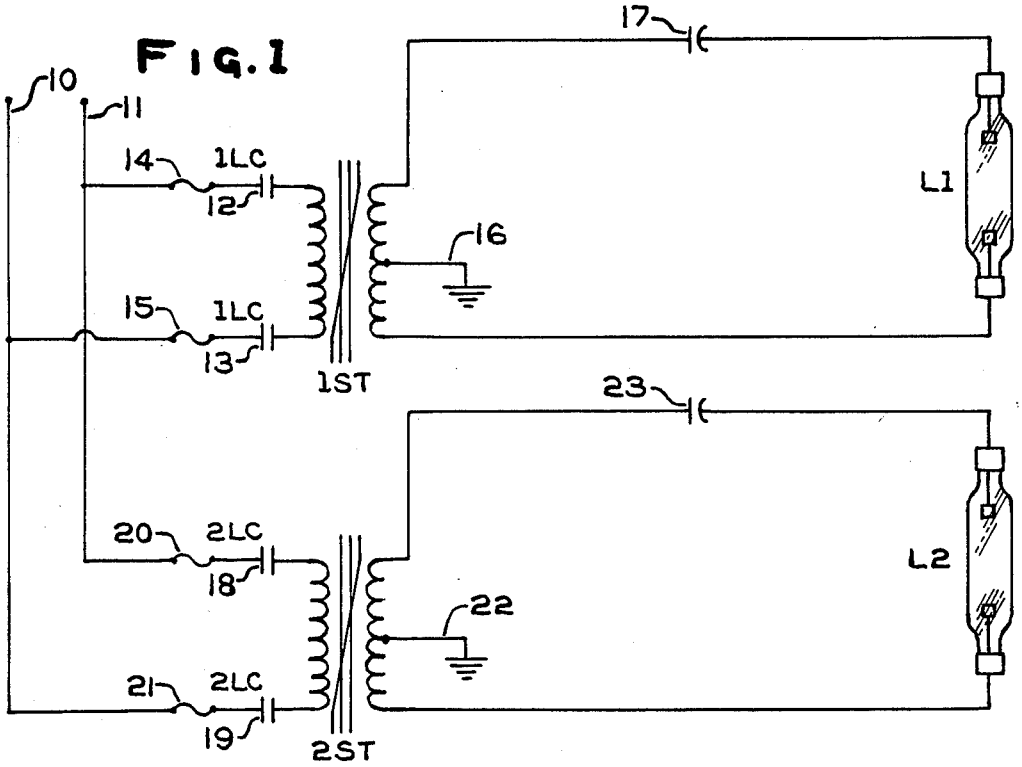
FIG. 1 shows an electrical system for supplying electrical power to ultraviolet light emitting lamps.

FIG. 1 represents an electrical system which may be used to supply power to two ultraviolet emitting lamps. Alternating electrical power is supplied from a source, not shown, through lines 10 and 11. Activation of switch 1LC closes contacts 12 and 13 thereby supplying power through fuses 14 and 15 to the primary of saturable core transformer 1ST. The center tap 16 is grounded. Power is supplied from the secondary of saturable core transformer 1ST through capacitor 17 to ultraviolet light emitting mercury vapor lamp L1. The capacitance of capacitor 17 is chosen such that the capacitive reactance provided by capacitor 17 and the inductive reactance provided by the secondary of saturable core transformer 1ST together provide a reactance suitable for operating lamp L1 at a desired power level. Switch 2LC comprising contacts 18 and 19 is analogous in structure and function to switch 1LC comprising contacts 12 and 13. Fuses 20 and 21 are analogous in structure and function to fuses 14 and 15. Saturable core transformer 2ST, center tap 22, capacitor 23 and lamp L2 are analogous in structure and function to saturable core transformer 1ST, center tap 16, capacitor 17 and lamp L1, respectively.

Although FIG. 1 illustrates a power supply system for two lamps, it will be observed that the modular system for one lamp is a substantial duplicate of the modular system for the other lamp. It will be appreciated, then, that a power supply system for any greater number of lamps can be constructed by the simple expedient of adding additional modular systems to the power supply system of FIG. 1.

Figure 2:
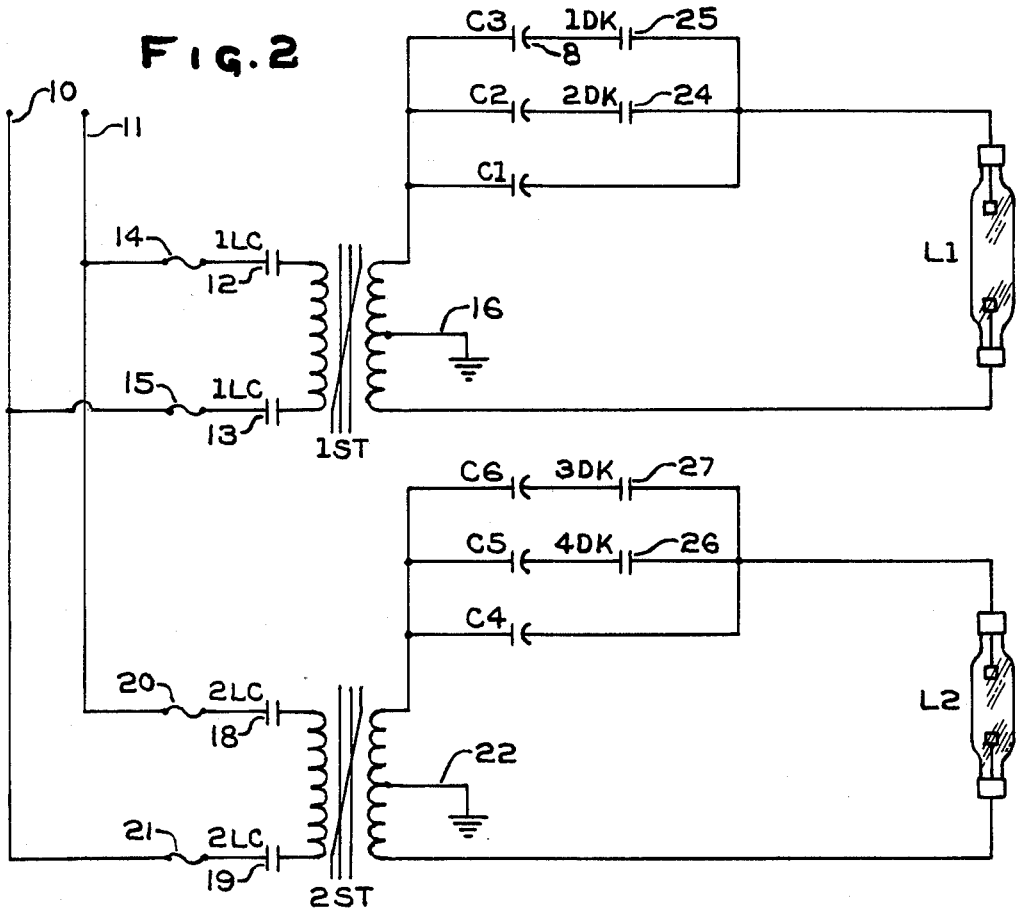
FIG. 2 shows an electrical system which is a modification of the electrical system of FIG. 1.
Figures 3, 4:
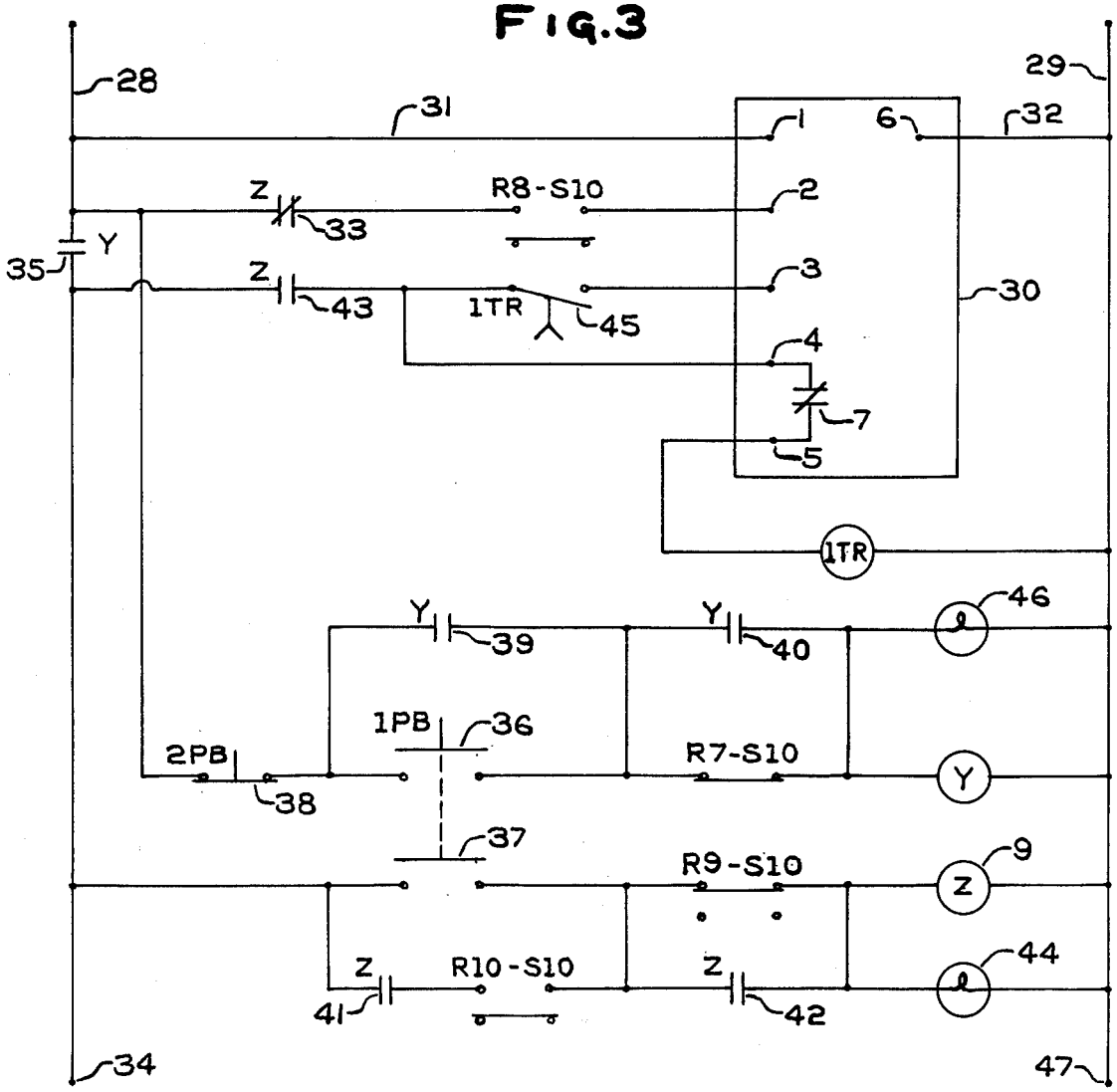
FIG. 3 shows a timing and programming system.
FIG. 4 is a programming diagram.

FIG. 2 shows a power supply system which is a modification of the system shown in FIG. 1. Capacitor 17 has been replaced by capacitors C1, C2 and C3 and switches 1DK and 2DK so that the capacitive reactance may be varied in discrete steps. Capacitor 23 has similarly been replaced by capacitors C4, C5 and C6 and switches 3DK and 4DK for the same reason. Capacitor C2 and contacts 24 of switch 2DK are connected in parallel to capacitor C1. Also connected in parallel to capacitor C1 are capacitor C3 and contacts 25 of switch 1DK. Similarly, capacitor C5 and contacts 26 of switch 4DK are connected in parallel to capacitor C4 as are capacitor C6 and contacts 27 of switch 3DK. The value of capacitor C1 is chosen such that when contacts 24 and contacts 25 are both open, lamp L1 emits about two-fifths of its maximum desired operating intensity. The value of capacitor C2 is chosen such that when contacts 24 are closed and contacts 25 are open, lamp L1 emits about two-thirds of its maximum desired operating intensity. The value of capacitor C3 is chosen such that when contacts 24 and contacts 25 are both closed, lamp L1 emits at about its maximum desired operating intensity.

The maximum desired operating intensity of lamp L2 is preferably, but not necessarily, about the same as that of lamp L1. The values of capacitors C4, C5 and C6 are chosen in a manner analogous to that described with respect to the values of capacitors C1, C2 and C3. Fractional values other than two-fifths and two-thirds of the maximum desired operating intensity may be chosen where desired.

The timing and programming system of FIG. 3 includes a step programmer 30. The step programmer comprises a rotatable drum having thereon an array of switches arranged in rows and steps. Each switch may be programmed such that it is either in the normally open position or the normally closed position. When a normally open switch is activated, it closes and when a normally closed switch is activated, it is opened. When the switches in the active position are deactivated, they resume their normal positions. As the drum rotates, the steps of switches are sequentially activated. Only one step is activated at a time and about the same time a step is activated, the preceding step is deactivated.

Contained within step programmer 30 is a mechanism for turning the drum which receives power through terminals 1 and 6. Power applied to terminals 2 and 6 closes a switch contained within the programmer which allows power supplied through terminals 1 and 6 to activate the turning mechanism which turns the drum continuously until power is removed from terminal 2. Power applied to terminals 3 and 6 activates a stepping mechanism so that the drum turns only one step and then stops. Removal of power from terminal 3 causes the stepping mechanism to reset so that a subsequent application of power to terminal 3 will activate the stepping mechanism and rotate the drum another single step. Bridging terminals 4 and 5 are contacts 7 of a normally closed switch contained within the programmer. As the drum advances to the next step, contacts 7 open. Upon reaching that step, contacts 7 close.

Switches in the drawings which are activated and deactivated by the step programmer are identified by a row (abbreviated "R") number and a step (abbreviated "S") number which serve to identify their positions in the array on the rotatable drum of the step programmer. Switches R7-S10, R8-S10, R9-S10 and R10-S10 of FIG. 3 and switches R1-S1 and R2-S2 of FIG. 5 are switches operated by the step programmer. In the drawings, these switches are shown in the position they occupy when step ten of the programmer is in the activated position.

The array of a step programmer having 100 switches arranged in ten rows and ten steps is represented diagrammatically in the programming diagram of FIG. 4. In the programming diagram, an X indicates those switches which are connected to various parts of one or more control circuits. Similar programming diagrams can be drawn for arrays of different sizes and configurations.

In the timing and programming system of FIG. 3, electrical power is supplied from a source, not shown, through lines 28 and 29. Power for rotating the drum of step programmer 30 is supplied to terminals 1 and 6 through lines 31 and 32. If power is first applied to lines 28 and 29 while any step other than step 10 is in the active position, switch R8-S10 is closed and power is supplied to terminal 2 through normally closed contacts 33 of switch Z and the closed switch R8-S10 thereby causing the drum to rotate continuously. When step 10 is reached, switch R8-S10 opens and the drum stops so that step 10 is in the active position. Terminal 34 is not connected to line 28 as the drum rotates to step 10 because contacts 35 of switch Y are open.

When step 10 of the programmer is in the active position, the programming sequence may be started because switches R7-S10 and R9-S10 are in the closed position. The programming sequence is begun by pushing normally open pushbutton 1PB which closes contacts 36 and 37. Contacts 38 of normally closed pushbutton 2PB are closed. Closure of contacts 36 therefore activates indicator lamp 46 and solenoid Y. Activation of solenoid Y closes contacts 35, 39 and 40 of switch Y. Closure of contacts 35 applies electrical potential to terminal 34 and activates indicator lamp 44 and solenoid Z through closed contacts 37 of pushbutton 1PB and closed switch R9-S10. Since contacts 39 and 40 are closed upon activation of solenoid Y, a path for power to solenoid Y and indicator lamp 46 is provided although pushbutton 1PB is subsequently released and/or switch R7-S10 is opened when the step programmer deactivates step 10. Activation of solenoid Z closes contacts 41, 42 and 43 and opens contacts 33. Closure of contacts 41 and 42 provides a path for power for solenoid Z and indicator lamp 44 when switch R10-S10 is closed. However, switch R10-S10 is not closed until step 10 is deactivated and step 1 is activated. For this reason, pushbutton 1PB must remain in the pushed position long enough for the step programmer to advance at least one step in order for the programming sequence to begin successfully. If pushbutton 1PB is released before the programmer has advanced to step 1, solenoid Z will not remain in the active position. The opening of contacts 33 prevents power from reaching terminal 2 even though switch R8-S10 closes as step 10 deactivates. Continuous rotation of the drum accordingly does not occur.

Because contacts 7 are closed as contacts 43 of switch Z assume the closed position, closure of the latter activates the solenoid of timing relay 1TR. The timing relay delays a predetermined time interval and then closes contacts 45 of switch 1TR thereby supplying power to terminal 3 thereby causing the drum of programmer 30 to advance one step which deactivates step 10 and activates step 1. As the drum advances to step 1, contacts 7 open thereby deactivating the solenoid of timing relay 1Tr which opens contacts 45 of switch 1TR. Notwithstanding the opening of contacts 45, the drum continues to rotate until step 1 is in the active position, then rotation ceases and contacts 7 close. Closure of contacts 7 again activates the solenoid of timing relay 1TR which, after the predetermined time interval has expired, closes contacts 45 of switch 1TR causing deactivation of step 1 and activation of step 2. So long as solenoid Z remains active, the step programmer 30 successively activates the steps in sequence at a rate governed by the duration of the predetermined time interval. The time interval employed may vary widely, but it is usually in the range of from about ½ second to about 10 seconds. An interval in the range of from about ½ second to about 4 seconds is typical. A time interval of about 2 seconds is preferred.

When the drum of step programmer 30 has completed a full revolution and step 10 is again activated, switches R7-S10 and R9-S10 are closed and switches R8-S10 and R10-S10 are opened. The opening of switch R10-S10 deactivates indicator lamp 44 and solenoid Z. Deactivation of solenoid Z causes contacts 41, 42 and 43 of switch Z to open and contacts 33 of switch Z to close. The opening of contacts 43 prevents the solenoid of timing relay 1TR from activating, thereby halting further stepwise advancement of the drum. The drum accordingly stops with step 10 in the active position. Since switch R8-S10 is open when step 10 is in the active position, power cannot reach terminal 2 notwithstanding the closure of contacts 33 and continuous rotation of the drum is prevented. Although the drum of step programmer 30 has completed one full revolution and stopped, terminal 34 remains connected to line 28 through the contacts 35 of switch Y which remain closed even after rotation of the drum has ceased.

The programming sequence may be stopped at any time by pushing normally closed pushbutton 2PB which opens contacts 38 thereby deactivating indicator lamp 46 and solenoid Y. Deactivation of solenoid Y causes contacts 35, 39 and 40 of switch Y to open. The opening of contacts 39 prevents indicator lamp 46 and solenoid Y from reactivating after pushbutton 2PB is released. The opening of contacts 35 deactivates indicator lamp 44 and solenoid Z, prevents power from reaching terminal 3 and breaks contact between terminal 34 and line 28. Since power cannot reach terminal 3, the drum of step programmer 30 cannot advance stepwise. Deactivation of solenoid Z causes contacts 41, 42 and 43 to open and contacts 33 to close. If step 10 is in the active position when contacts 33 close, switch R8-S10 is open and power is prevented from reaching terminal 2 and continuous rotation of the drum cannot occur. If, however, a step other than step 10 is in the active position when contacts 33 close, switch R8-S10 is closed and the drum rotates continuously until step 10 is activated and switch R8-S10 is opened at which time continuous rotation of the drum ceases. During the continuous rotation of the drum, open contacts 35 of switch Y prevent power from reaching terminal 34.

From the above, it may be seen that the purpose of switch R7-S10 is to assure that if power is first applied to lines 28 and 29 while any step other than step 10 is in the active position, power cannot be applied to terminal 34 until step 10 has been activated. Switch R8-S10 causes the drum to rotate continuously until step 10 is in the active position either when power is first applied to lines 28 and 29 or after pushbutton 2PB has been pushed. Switch R9-S10 assures that step 10 is in the active position before the programming sequence can be begun by pushing pushbutton 1PB. Switch R10-S10 causes rotation of the drum to cease after it has completed one revolution from step 10 in the active position to step 10 in the active position.

In the system of FIG. 5, terminals 34 and 47 correspond to terminals 34 and 47, respectively, of FIG. 3. Alternating electrical power may be supplied to the system of FIG. 5 only when contacts 35 of switch Y (FIG. 3) are closed. Although contacts 35 may be closed, contacts 50, 51 and 52 are open when function switch F1 is in the OFF position and solenoid 1LC is inactive. Accordingly, contacts 12 and 13 (FIGS. 1 and 2) are open and lamp L1 is not operating.

When function switch F1 is in the AUTO position, contacts 50 and 52 are closed and contacts 51 are open. If contacts 35 of switch Y are also closed, alternating electrical power may be supplied to the system. However, because contacts 35 of switch Y first close only when step 10 is in the active position, switch R1-S1 cannot be closed when power is first supplied to line 54, with the result that solenoid 1LC remains inactive. Therefore, contacts 12 and 13 are open and lamp L1 is not operating. When the programmer causes step 1 to become activated, switch R1-S1 closes, solenoid 1LC is activated and contacts 12, 13 and 53 of switch 1LC are closed. Closure of contacts 12 and 13 applies power to lamp L1. Closure of contacts 53 provides a circuit to maintain solenoid 1LC in the active state when switch R1-S1 is opened as the programmer deactivates step 1 and activates step 2. Timer 55, which in parallel with solenoid 1LC and hence is activated when solenoid 1LC is activated, measures the accumulated time that power is applied to lamp L1.

When lamp L1 is operating satisfactorily, the voltage difference across the terminals of the lamp is less than the voltage across the secondary of saturable core transformer 1ST. If lamp L1 should fail either during start-up or during later operation, the voltage difference across the terminals of the lamp is about the same as the voltage across the secondary of saturable core transformer 1ST. The voltage difference across lamp L1 is monitored by voltage sensor 1VS. Power to operate the voltage sensor is supplied through lines 48 and 49. Lines connecting voltage sensor 1VS to the terminals of lamp L1 are not shown. So long as the voltage difference across the terminals of lamp L1 is below a preestablished value of voltage which is between the operating voltage difference and the open circuit voltage difference, voltage sensor 1VS does not activate switch K1. Contacts 56 (FIG. 5) of switch K1 remain open and contacts 114 (FIG. 6) remain closed. If lamp L1 fails, voltage sensor 1VS activates switch K1 which closes contacts 56 and opens contacts 114. Closure of contacts 56 activates indicator lamp 57 and solenoid 1CR which in turn activates switch 1CR causing contacts 58 to open and contacts 59 to close. Opening of contacts 58 deactivates timer 55 and solenoid 1LC. Deactivation of solenoid 1LC causes contacts 12, 13 and 53 to open. The opening of contacts 12 and 13 provides a safety feature by removing the application of electrical potential from lamp L1. Since contacts 53 are now open, timer 55 and solenoid 1LC cannot be reactivated merely by closing contacts 58. Closure of contacts 59 provides an additional circuit to maintain solenoid 1CR in the active state even though contacts 56 of switch K1 subsequently open. Once solenoid 1CR is in the active state, it may be deactivated by moving function switch F1 to the OFF position, by pushing pushbutton 2PB or by disconnecting line 28 or line 29 from the source of electrical power.

Function switch F1 may conveniently, but not necessarily, be constructed so that upon being released in the MANUAL position, it returns to the AUTO position. Spring biasing is ordinarily the means employed to effectuate the return. When function switch F1 is in the MANUAL position, contacts 50, 51 and 52 are closed.

If not already activated, timer 55 and solenoid 1LC are activated by closure of contacts 51 which are shunted around switch R1-S1 and contacts 53 of switch 1LC. Activation of solenoid 1LC closes contacts 12, 13 and 53 of switch 1LC. When function switch F1 is released, it springs back to the AUTO position thereby opening contacts 51. However, contacts 50 remain closed so that solenoid 1LC remains active. If lamp L1 should fail while function switch F1 is in the MANUAL position, closure of contacts 56 activates indicator lamp 57 and solenoid 1CR. Activation of solenoid 1CR opens contacts 58 and closes contacts 59 of switch 1CR. The opening of contacts 58 deactivates timer 55 and solenoid 1LC even though contacts 51 of switch F1 are in the closed position.

FIG. 5 also shows a system for controlling the operation of lamp L2 which is analogous to that for controlling lamp L1. In the analogous system, lines 68 and 69, voltage sensor 2VS, contacts 70, 71 and 72 of function switch F2, contacts 73 of switch 2LC, solenoid 2LC, timer 75, contacts 76 of switch K2, indicator lamp 77, contacts 78 and 79 of switch 2CR, solenoid 2CR, lines 80 and 81 and terminal 82 correspond to lines 48 and 49, voltage sensor 1VS, contacts 50, 51 and 52 of function switch F1, contacts 53 of switch 1LC, solenoid 1LC, timer 55, contacts 56 of switch K1, indicator lamp 57, contacts 58 and 59 of switch 1CR, solenoid 1CR, lines 60 and 61 and terminal 62, respectively.

Although FIG. 5 illustrates a control system for two lamps, it will be observed that the modular system for one lamp is a substantial duplicate of the modular system for the other lamp. Similar systems for any greater number of lamps can be constructed by the addition of further modular systems to the control system of FIG. 5. The programming diagram of FIG. 4, for example, shows switches for six lamps, in which case a control system similar to FIG. 5 would contain six modules.

If function switch F1 is in the MANUAL position when power is first applied to terminal 34, power is supplied through closed contacts 51 of switch F1 to activate solenoid 1LC and timer 55. Activation of solenoid 1LC closes contacts 12 and 13 of switch 1LC causing power to be applied to lamp L1. In like manner, power will be simultaneously applied to those lamps whose function switches corresponding to function switch F1 are in the MANUAL position. The net effect is that the sequencing program provided by step programmer 30 is bypassed for lamps having function switches in the MANUAL position. So long as only a few lamps have function switches in the MANUAL position when power is first applied to terminal 34, the surge of current will remain within acceptable values. If a large number of lamps have function switches in the MANUAL position, the surge may reach unacceptable values. Such a surge, however, cannot occur when the function switches are in the AUTO position. In order to alleviate any possibility of overloading the circuit, it is preferred that the function switches, or at least an acceptable portion of them, be constructed so that upon being released from the MANUAL position, they return to the AUTO position.

The systems of FIGS. 3 and 5 may be used by themselves to operate the systems of FIGS. 1 or 2. When the system of FIG. 2 is employed, contacts 24, 25, 26 and 27 may be operated manually or automatically. However, it is preferred to use the control circuit of FIG. 6 for this purpose.

Figure 6:
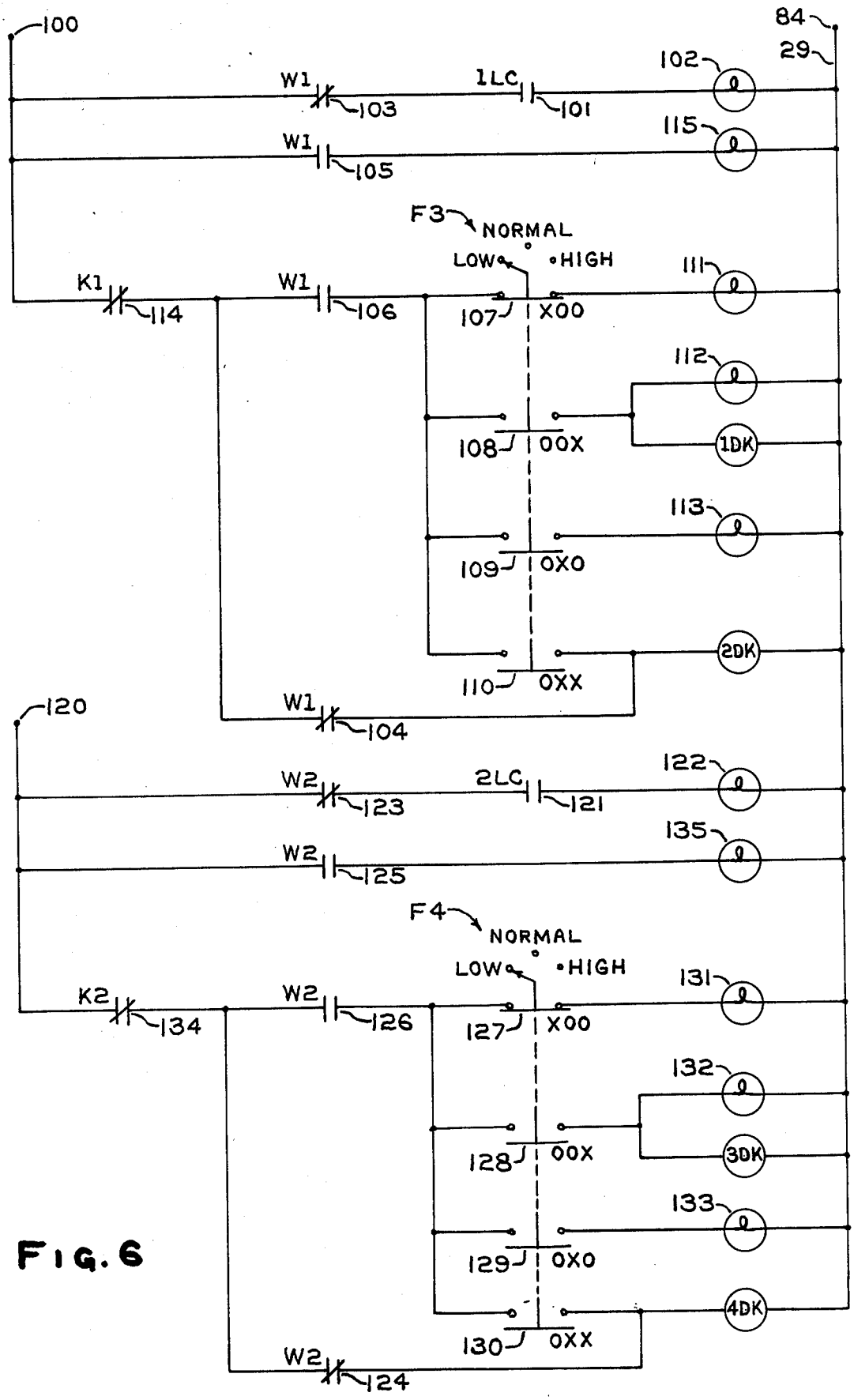
FIG. 6 shows an additional system for further operating the electrical system of FIG. 2.

Terminal 84 of FIG. 6 corresponds to terminal 84 of FIG. 5. Terminal 100 corresponds to terminal 62 of FIG. 5, although it is permissible for terminal 100 to correspond to terminal 83.

When an electrical potential is applied to the terminals of a medium or high pressure mercury vapor lamp, the conductance of the lamp is found to change over a short period, usually on the order of a minute or two. During this period, the voltage difference across the terminals of the lamp decreases from the striking potential to a small value, and then as the lamp warms up, the voltage difference increases to an operating value where the conductance of the lamp has substantially reached a steady state. Although the operating voltage difference may be varied after the lamp has warmed up, it is preferred that warmup take place only under conditions where the operating voltage difference is a single predetermined value. Voltage sensor 1VS (FIG. 5) which monitors the voltage difference across lamp L1, is constructed not only to activate switch K1 when the voltage difference across lamp L1 approaches the open circuit voltage difference during lamp failure, but to additionally activate switch W1 when the voltage difference almost reaches the operating voltage difference during warmup. The set point should be close to the operating voltage difference, but not so near that minor normal fluctuations occurring during operation will cause switch W1 to flutter between the active and inactive states. When solenoid 1LC is activated, contacts 12 and 13 (FIG. 2) and contacts 101 (FIG. 6) of switch 1LC close. Closure of contacts 12 and 13 applies power to lamp L1. Closure of contacts 101 activates indicator lamp 102 which indicates that lamp L1 is warming up. When the voltage difference across the terminals of lamp L1 has almost reached the operating voltage difference, voltage sensor 1VS activates switch W1. Activation of switch W1 causes contacts 103 and 104 to open and contacts 105 and 106 to close. Opening contacts 103 deactivates indicator lamp 102. Closure of contacts 105 activates indicator lamp 107 which indicates that the voltage difference across the terminals of lamp L1 has about reached operating voltage difference. Closure of contacts 106 permits power to reach switch F3.

When switch F3 is in the LOW position, contacts 107 are closed and contacts 108, 109 and 110 are open. Because contacts 108 and 110 are open, solenoids 1DK and 2DK and indicator lamp 112 are inactive. Consequently, contacts 25 and 24 (FIG. 2) are open. Closed contacts 107 permit power to reach indicator lamp 111 which indicates that lamp L1 is operating in the LOW mode. Indicator lamp 113 is inactive because contacts 109 are open.

When switch F3 is in the NORMAL position, contacts 109 and 110 are closed and contacts 107 and 109 are open. Because contacts 107 and 108 are open, indicator lamps 111 and 112 and solenoid 1DK are inactive. Closed contacts 110 cause solenoid 2DK to be active. Contacts 24 of switch 2DK (FIG. 2) are therefore closed. Closed contacts 109 cause indicator lamp 113 to be active, thereby indicating that lamp L1 is operating in the NORMAL mode.

When switch F3 is in the HIGH position, contacts 108 and 110 are closed and contacts 107 and 109 are open. Because contacts 107 and 109 are open, indicator lamps 111 and 113 are inactive. Closed contacts 108 and 110 cause indicator lamp 112 and solenoids 1DK and 2DK to be active. Contacts 24 and 25 (FIG. 2) are therefore closed. Active indicator lamp 112 indicates that lamp L1 is operating in the HIGH mode.

When power is first applies to lamp L1, contacts 104 are closed and contacts 106 are open. Solenoid 2DK is, therefore, active irrespective of the position of switch F3 until lamp L1 warms up. This assures that warm-up will occur only when lamp L1 is being operated in the NORMAL mode. When the voltage difference across the terminals of lamp L1 has almost reached the operating voltage difference, voltage sensor 1VS activates switch W1. This closes contacts 106 and opens contacts 104 to permit lamp L1 to operate in the mode corresponding to the position of switch F3.

If lamp L1 should fail, contacts 114 of switch K1 are opened as heretofore described. Opening contacts 114 deactivates any of indicator lamps 111, 112 and 113, and solenoids 1DK and 2DK which were active just prior to the failure of lamp L1. Voltage sensor 1VS is designed such that substantially open circuit voltage difference must be applied to the terminals of lamp L1 for a finite period of time before voltage sensor 1VS will activate switch K1. The time period is long enough so that open circuit potential differences may be momentarily applied to the terminals of lamp L1 during start-up without activating switch K1. If lamp L1 is functional, the voltage difference across the terminals of lamp L1 will drop below the value necessary to activate switch K1 before switch K1 is activated.

FIG. 6 also shows a control circuit for controlling the operating level of lamp L2 which is analogous to that just described with respect to lamp L1. In the analogous system, terminal 120, switches F4, W2 and K2, contacts 121, 123, 124, 125, 126, 127, 128, 129, 130 and 134 and indicator lamps 122, 131, 132, 133 and 135 correspond to terminal 100, switches F3, W1 and K1, contacts 101, 103, 104, 105, 106, 107, 108, 109, 110 and 114 and indicator lamps 102, 111, 112, 113 and 115, respectively.

Although FIG. 6 illustrates a control system for two lamps, the modular system for one lamp is a substantial duplicate of the modular system for the other lamp. Similar systems for any greater number of lamps can be constructed by the addition of further modular systems to the system of FIG. 6.

Any suitable source which emits ultraviolet light, viz., electromagnetic radiation having a wavelength in the range of from about 180 to about 400 nanometers, may be used in the practice of this invention. Examples of suitable sources are mercury arcs, carbon arcs, low pressure mercury lamps, medium pressure mercury lamps, high pressure mercury lamps, swirl-flow plasma arc, ultraviolet light emitting diodes and ultraviolet light emitting lasers. Particularly preferred are ultraviolet light emitting lamps of the medium or high pressure mercury vapor type. Such lamps usually have fused quartz envelopes to withstand the heat and transmit the ultraviolet radiation and are ordinarily in the form of long tubes having an electrode at both ends. Examples of these lamps are PPG Models 60-2032, 60-0393, 60-0197 and 60-2031 and Hanovia Models 6512A431, 6542A431, 6565A431 and 6577A431. When the source employed does not require a warm-up period, the circuits of FIG. 6 may be modified by eliminating the functions of switches W1 and W2.

The voltages and currents used to operate the ultraviolet light sources are known in the art. When, for example, the ultraviolet light emitting lamps L1 and L2 are medium pressure mercury lamps, each having a length of about 107 centimeters, an alternating current voltage of about 480 volts may be applied to lines 10 and 11 of FIGS. 1 and 2, and the secondary voltage of saturable core transformers 1ST and 2ST may be about 1800 volts. Although alternating current is preferred, direct current may be used by eliminating the saturable core transformers or by adding rectifiers after the transformers and by substituting resistors of appropriate value for the various capacitors.

Similarly, the voltages and currents used to operate the solenoids, indicator lamps, voltage sensors, step programmer and timing relay are well known in the art. Either alternating current or direct current may be used. Advantageously, electrical power may be supplied at a potential of about 117 volts AC.

Substantially any ultraviolet light curable coating composition can be cured using the present invention. These ultraviolet light curable coating compositions contain at least one polymer, oligomer or monomer which is ultraviolet light curable. Examples of such ultraviolet light curable materials are unsaturated polyesters, acrylic (including the α-substituted acrylic) functional monomers, oligomers and polymers, the epoxy resins in admixture with masked Lewis acids, and the aminoplasts used in combination with a compound which ultraviolet light converts to an acid. Examples of such a compound to be used with aminoplast resins are the chloromethylated or bromomethylated aromatic ketones as exemplified by chloromethylbenzophenone.

The most commonly used ultraviolet light curable compounds contain a plurality of sites of ethylenic unsaturation which, under the influence of ultraviolet light become crosslinking sites through addition reactions. The sites of ethylenic unsaturation may lie along the backbone of the molecule or they may be present in side chains attached to the molecular backbone. As a further alternative, both of these arrangements may be present concurrently.

The ethylenically unsaturated polyesters constitute a preferred class of ultraviolet light curable polymer. These polyesters are ordinarily esterification products of ethylenically unsaturated polycarboxylic acids and polyhydric alcohols. Usually, the ethylenic unsaturation is in the alpha, beta position.

For purposes of the present invention, the aromatic nuclei of aromatic compounds such as phthalic acid are generally regarded as saturated since the double bonds do not ordinarily react by addition as do ethylenic groups. Therefore, whenever the term "saturated" is utilized, it is to be understood that such term includes aromatic unsaturation or other form of unsaturation which does not react by addition, unless otherwise qualified.

Organic ultraviolet light curable acrylic oligomers, which may be used in the invention, generally comprise divalent, trivalent or tetravalent organic radicals whose bonds are satisfied with unsubstituted acrylyloxy or α-substituted acrylyloxy groups. The polyvalent radical may be aliphatic, cycloaliphatic or aromatic. Usually, the molecular weight of the oligomer is in the range of from about 170 to about 1000. Examples of such oligomers are the diacrylates and dimethacrylates of ethylene glycol, 1,3-propanediol, propylene glycol, 2,3-butanediol, 1,4-butanediol, 2-ethylbutane-1,4-diol, 1,5-pentanediol, 1,6-hexanediol, 1,7-heptanediol, 1,8-octanediol, 1,9-nonanediol, 1,10-decanediol, 2,10-decanediol, 1,4-cyclohexanediol, 1,4-dimethylolcyclohexane, 2,2-diethylpropane-1,3-diol, 2,2-dimethylpropane-1,3-diol, 3-methylpentane-1,4-diol, 2,2-diethylbutane-1,3-diol, 4,5-nonanediol, diethylene glycol, triethylene glycol, dipropylene glycol, neopentyl glycol, 5,5-dimethyl-3,7-dioxanonane-1,9-diol and 2,2-dimethyl-3-hydroxypropyl 2,2-dimethyl-3-hydroxypriopionate; the triacrylates, trimethacrylates, diacrylates and dimethacrylates of glycerol, 1,1,1-trimethylolpropane and trimethylolethane; and the tetracrylates, tetramethacrylates, triacrylates, trimethacrylates, diacrylates and dimethacrylates of pentaerythritol and erythritol. The acrylic groups on the oligomer molecules are usually the same, but they may be different as exemplified by the compound 2,2-dimethyl-1-acrylyloxy-3-methacrylyloxypropane.

Other examples of satisfactory acrylic oligomers are acrylic polyester and acrylic polyamide molecules represented by the formulae

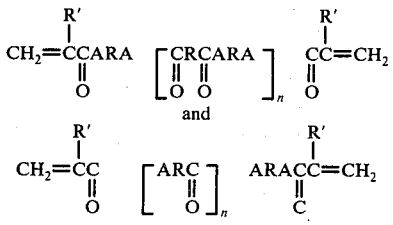

(I)

and (II)

wherein $n$ is integer in the range of from 1 to 4;

each R independently represents a divalent aliphatic, cycloaliphatic or aromatic hydrocarbon radical having from 1 to 10 carbon atoms;

each R′ independently represents hydro, methyl or ethyl;

and each A independently represents O or NH.

It is preferred that every A represent O. The polyester and polyamide oligomers represented by formula (I) may be prepared by reacting dicarboxylic acids or acid amides and dihydric alcohols ordiamines and then reacting the product with an unsubstituted acrylic acid or an α-substituted acrylic acid. The acrylic polyester and polyamide oligomers represented by formula (II) may be prepared by reacting a hydroxyfunctional monocarboxylic acid, a dimer, trimer or a tetramer of such acid, an amino functional monocarboxylic acid or a dimer, trimer or tetramer of such acid with an unsubstituted or α-substituted acrylic acid. Where desired, the lactone may be used in lieu of the hydroxy functional monocarboxylic acid and the lactam may be used in place of the amino functional monocarboxylic acid.

Vinyl monomers which crosslink with the compound containing a plurality of sites of ethylenic unsaturation to form thermosetting materials may be present in the coating composition. Vinyl monomers are especially used with the unsaturated polyesters. Examples of vinyl monomers which may be used are styrene, α-methylstyrene, divinylbenzene, methyl acrylate, methyl methacrylate, ethyl acrylate, ethyl methacrylate, propyl acrylate, propyl methacrylate, butyl acrylate, butyl methacrylate, hexyl acrylate, hexyl methacrylate, octyl acrylate and octyl methacrylate. The preferred vinyl monomers are liquid compounds miscible with the first component. These vinyl monomers are preferably free of nonaromatic carbon-carbon conjugated double bonds. The use of one or more vinyl monomers is desirable because the greater mobility of the smaller vinyl monomer molecule, as compared to the much larger first component, allows crosslinking to proceed faster than if the vinyl monomer were absent. Another benefit is that the vinyl monomer usually acts as a reactive solvent for the first component thereby providing coating compositions having a satisfactorily low viscosity without using an inordinate amount, if any at all, of volatile, nonreactive solvent.

The vinyl monomer, or mixtures of vinyl monomers, may be employed over a broad range. At the lower end of the range, no vinyl monomer need be used. The upper end of the range is a moderate excess of vinyl monomer over the stoichiometric amount required to crosslink the ethylenic unsaturation of the first component. The amount of monomer should be sufficient to provide a liquid, flowable, interpolymerizable mixture. Ordinarily, the monomer will be present in the coating composition in the range of from about 0 to about 45 percent by weight of the binder of the coating composition. When used, the vinyl monomer will ordinarily be in the range of from about 15 to about 30 percent by weight of the binder.

Extender pigments which are generally transparent to both ultraviolet light and visible light are optional ingredients which are often included in the coating composition. Examples of suitable extender pigments are finely divided particles of silica, barytes, calcium carbonate, talc, magnesium silicate, aluminum silicate, etc. The extender pigments do not ordinarily provide significant additional hiding, but they accelerate the rate at which opacity is obtained. Extender pigment is generally present in an amount in the range of from about 0 to about 40 percent by weight of the coating composition. An amount in the range of from about 0 to about 15 percent is more often employed. When extender pigment is used, it is usually present in the range of from about 1 to about 15 percent by weight of the coating composition. Although a single extender pigment is ordinarily used, mixtures of several extender pigments are satisfactory.

Opacifying or coloring pigments may also be included in the ultraviolet light curable coating compositions. The amount of these pigments should not be so great as to seriously interfere with the curing of the binder. Dyes and tints may similarly be included.

Another optional ingredient which is often included in the coating composition is an inert volatile organic solvent.

Photoinitiators, photosensitizers or both photoinitiators and photosensitizers are often included in ultraviolet light curable coating compositions. These materials are well known to the art. The preferred photosensitizer is benzophenone and the preferred photoinitiators are isobutyl benzoin ether, mixtures of butyl isomers of butyl benzoin ether and α,α-diethyoxyacetophenone.

The photoinitiator, photosensitizer or mixture of these is usually present in the ultraviolet light curable coating composition in an amount in the range of from about 0.01 percent to about 50 percent by weight of the binder of the coating composition. An amount in the range of from about 0.05 percent to about 10 percent is more often used. An amount in the range of from about 0.1 percent to about 5 percent is preferred.

Although several of the optional materials commonly found in ultraviolet light curable coating compositions have been described, the list is by no means inclusive. Other materials may be included for purposes known to the art.

Although the curing of the uncrosslinked coating composition (A-stage) may be carried out only until a gel (B-stage) is formed, it is generally preferred that curing should continue until the fully-cured state (C-stage) is obtained where the coating has been crosslinked into a hard, infusible film. These fully-cured films exhibit the high abrasion resistance and high mar resistance customarily associated with C-stage polymer films.

The ultraviolet light curable coating compositions are used to form cured adherent coatings on substrates. The substrate is coated with the coating composition using substantially any technique known to the art. These include spraying, curtain coating, dipping, roller application, painting, brushing, printing, drawing and extrusion. The coated substrate is then passed under the lamps of the ultraviolet light processor so that the coating is exposed to ultraviolet light of sufficient intensity for a time sufficient to crosslink the coating during the passage.

The times of exposure to ultraviolet light and the intensity of the ultraviolet light to which the coating composition is exposed may vary greatly. Generally, the exposure to ultraviolet light should continue to the C-stage when hard, mar and abrasion resistant films result. In certain applications, however, it may be desirable for the curing to continue only to the B-stage.

Substrates which may be coated with the compositions of this invention may vary widely in their properties. Organic substrates such as wood, fiberboard, particle board, composition board, paper, cardboard and various polymers such as polyesters, polyamides, cured phenolic resins, cured aminoplasts, acrylics, polyurethanes and rubber may be used. Inorganic substrates are exemplified by glass, quartz and ceramic materials. Many metallic substrates may be coated. Exemplary metallic substrates are iron, steel, stainless steel, copper, brass, bronze, aluminum, magnesium, titanium, nickel, chromium, zinc and alloys.

Cured coatings of the ultraviolet light curable coating composition usually have thicknesses in the range of from about 0.001 millimeter to about 3 millimeters. More often, they have thicknesses in the range of from about 0.007 millimeter to about 0.3 millimeter. When the ultraviolet light curable coating composition is an ultraviolet light curable printing ink, the cured coatings usually have thicknesses in the range of from about 0.001 millimeter to about 0.03 millimeter.

I claim:

1. An ultraviolet light processor comprising:

a. a sequence of members for emitting ultraviolet light when connected to a source of electrical power;

b. means for automatically and sequentially connecting members of said sequence to a source of electrical power to thereby cause said members to emit ultraviolet light; and c. timing means including only a single timing relay, said timing means cooperating with said connecting means for interposing a time interval between connections of adjacent members of said sequence to said source of electrical power.

2. The ultraviolet light processor of claim 1 including means for initiating the operation of said connecting means and said timing means.

3. The ultraviolet light processor of claim 2 including means for permitting said connecting means to function only from the beginning of the connecting sequence.

4. The ultraviolet processor of claim 1 wherein said time interval is in the range of from about ½ second to about 10 seconds.

5. The ultraviolet light processor of claim 1 wherein:

a. said electrical power is alternating; and b. alternating electrical power is applied to each member through a reactance comprising an inductive reactance and a capacitive reactance.

6. The ultraviolet lignt processor of claim 5 including means for varying the reactance.

7. The ultraviolet light processor of claim 5 including means for varying the capacitive reactance.

8. The ultraviolet light processor of claim 7 wherein said varying means varies the capacitive reactance through a plurality of discrete steps of capacitive reactance.

9. The ultraviolet light processor of claim 8 wherein said members are medium or high pressure mercury vapor lamps.

10. The ultraviolet light processor of claim 9 including means for causing alternating electrical power to be applied to said lamps through a predetermined value of reactance at least until said lamps are warmed up.

11. The ultraviolet light processor of claim 10 including means for changing the value of capacitive reactance after said lamps are warmed up.

12. The ultraviolet light processor of claim 1 including means for disconnecting any member of the sequence from the source of electrical power upon failure of said member.

13. An ultraviolet light processor comprising:

a. a sequence of medium or high pressure mercury vapor lamps for emitting ultraviolet light when connected to a source of alternating electrical power;

b. means for automatically and sequentially connecting lamps of said sequence through a reactance to a source of electrical power to thereby cause said lamps to emit ultraviolet light, wherein said reactance comprises an inductive reactance and a capacitive reactance;

c. timing means including only a single timing relay, said timing means cooperating with said connecting means for interposing a time interval in the range of from about ½ second to about 10 seconds between connections of adjacent lamps of said sequence to said source of alternating electrical power;

d. means for initiating the operation of said connecting means and said timing means;

e. means for permitting said connecting means to function only from the beginning of the connecting sequence;

f. means for varying the capacitive reactance through a plurality of discrete steps of capacitive reactance; and g. means for causing alternating electric power to be applied to said lamps through a predetermined value of reactance at least until said lamps are warmed up.

14. The ultraviolet light processor of claim 13 including means for changing the value of capacitive reactance after said lamps are warmed up.

15. The ultraviolet light processor of claim 13 including means for disconnecting any lamp of the sequence from the source of electrical power upon failure of said lamp.

* * * * *